US005160030A

United States Patent [19]

Binsfeld

[11] Patent Number: 5,160,030

[45] Date of Patent: Nov. 3, 1992

[54] TEARING SLIT ARRANGEMENT FOR A TEAR-APART PACKAGE

[75] Inventor: Michael A. Binsfeld, Chicago, Ill.

[73] Assignee: Illinois Tool Works, Inc., Glenview, Ill.

[21] Appl. No.: 717,696

[22] Filed: Jun. 19, 1991

[51] Int. Cl.[5] ..... B65D 71/08

[52] U.S. Cl. ..... 206/497; 206/432; 229/205

[58] Field of Search ..... 229/205, 243; 206/432, 206/497, 427

[56] References Cited

U.S. PATENT DOCUMENTS

| | | | |
|---|---|---|---|
| 3,175,752 | 3/1965 | Stabenow | 206/497 X |
| 3,273,302 | 9/1966 | Walter | 206/497 X |
| 3,344,975 | 10/1967 | Stoker, Jr. | 206/497 X |
| 3,403,840 | 10/1968 | Mathes | 206/497 X |
| 3,442,436 | 5/1969 | Kirby, Jr. | 206/497 X |
| 3,488,913 | 1/1970 | Burgess . | |
| 3,693,787 | 9/1972 | Duerr | 206/432 |
| 3,747,749 | 7/1973 | Brown | 206/497 X |
| 4,586,312 | 5/1986 | Limousin . | |
| 4,919,265 | 4/1990 | Lems et al. . | |

*Primary Examiner*—Bryon P. Gehman

*Attorney, Agent, or Firm*—Trexler, Bushnell, Giangiorgi & Blackstone, Ltd.

[57] ABSTRACT

A package for releasably retaining a plurality of containers together as a unit comprises a plurality of sides composed of a material having a pre-determined molecular structure. At least one side has uniquely arranged, variably rupturable slits for selectively releasing containers. The slits are aligned substantially parallel with the molecular structure of the material.

5 Claims, 2 Drawing Sheets

TEARING SLIT ARRANGEMENT FOR A TEAR-APART PACKAGE

BACKGROUND AND SUMMARY OF THE INVENTION

The present invention relates generally to a new and unique construction for an easy-open, tear-apart package useful for releasably holding a plurality of containers together as a single unit. The invention relates more specifically to a tear-open package comprises a film of material, which shrinks upon application of heat thereto to releasably retain and to constrictively captivate a plurality of containers encompassed thereby.

Packaging a plurality of containers together as a single unit can be achieved in a wide variety of ways and methods commonly known to individuals skilled in the relevant art. Such ways and methods include, for example, encompassing containers in cardboard boxes and trays to form a "case" or a "twelve pack," encircling the outer peripheries of the containers with a flexible, resilient material to form a container carrier, and surrounding the containers with a flexible, resilient material that shrinks upon the application of heat or an appropriately directed force.

One of the more popular methods of packaging a plurality of containers is to surround the containers with a sheet of heat shrinkable polymetric film material which shrinks upon application of heat to conform to the exterior configuration defined by the plurality of containers, thereby captivating the same. A pattern of slits or perforations is supplied to the sheet of polymetric film material either before the heat shrinking process, as in the method disclosed in the patent of Limousin, U.S. Pat. No. 4,586,312, or after the heat shrinking process, as in the method disclosed in the patent of Kennedy, U.S. Pat. No. 3,016,131, so that sheet may be ruptured to release the containers.

Use of each of these various methods results in a differently formed and similarly functioning container or package. Specifically, the patent of Burgess, U.S. Pat. No. 3,488,913, discloses a method of producing a shrink wrapped package having two distinct film regions which overlap each other, meet edge to edge, or are separated. To open the package, one must pull one film region away from the other. However, use of this packaging method requires utilization of a separate tray to act as a bottom support for the containers and as a pivot point about which the film regions can be moved. The necessity of the separate tray adds to the cost of and time needed for implementation of the method.

The patent of Limousin, U.S. Pat. No. 4,586,312, discloses a method for producing a heat shrinkable package having a break-away access panel to allow removal of the containers. This method produces a package having a removable longitudinal strip making the containers retained in the package accessible from the package exterior. To produce the removable strip, perforations or slits must be located on the wrapped package before the heat shrinking process takes place. In order to prevent rupturing of the slits during the heat shrinking process, the portion of the package bearing the slits is placed facing a conveyor belt which moves the package through a heat tunnel or other apparatus for applying thermal energy to the shrink wrap. This method may not be desirable in some applications due to the particular sensitivity of the method to orientation of the package.

The patent of Lems et al, U.S. Pat. No. 4,919,265, discloses a method for making a film encased package. In this method, the package is formed by spirally applying a stretch film to the exterior surfaces of a plurality of containers. However, this method requires the use of sub-packages, and does not seem to be useful in creating a package of individual, free containers.

OBJECTS AND SUMMARY OF THE INVENTION

A general object of the present invention is to provide an improved construction for an easy-open, tear-apart heat shrink wrap package useful for retaining containers for various shapes and sizes.

A more specific object of the invention is to provide a tear-apart package having notches or slits which facilitate opening of the package, and which are arranged so as to reduce any possibility of package rupture during application to the articles being retained.

Another object of the present invention is to provide a package having a bullseye or constricted periphery formed by a heat shrinking process along at least two sides thereof.

A further object of the invention is to provide a package having uniquely constructed carrying means for facilitating translation of the package.

An additional object of the present invention is to provide a package that can be utilized without the need for sub-packages or separate trays.

Another object of the invention is to provide a package having means for releasing the containers disposed therein which can be applied to the package before heat shrinking and which will not rupture during the heat shrinking process or during normal translation of the package.

A further object of the present invention is to provide a package having flaps extending beyond at least two edges of the package which form carrying means during the heat shrinking process.

An additional object of the invention is to provide a package having essentially intersecting diagonal perforations in the top surface thereof for releasing the containers therein.

Another object of the present invention is to provide a package which can be opened completely, thereby allowing free to the containers disposed therein, while still being useful to transport and hold the containers.

A further object of the invention is to provide a package which can be opened easily without the aid of tools.

An additional object of the present invention is to provide a package composed of a material having a pre-determined molecular structure having means for releasing containers in the form of slits oriented congruently with the molecular structure of the material.

An easy-open, tear-apart package, constructed according to the teachings of the present invention, useful for releasably retaining a plurality of containers together as a single unit comprises a plurality of sides composed of a material having a pre-determined molecular structure. At least one side has means for selectively releasing containers. The means is aligned substantially parallel with the molecular structure of the material.

The package is composed of a flexible, resilient polymetric film material shrinkable in response to application of thermal energy thereto in order to constrict and to conform to the external configuration of a plurality of containers, thereby releasably holding the same together as a unit. The package provides carrying means useful in the translation of the package and the containers held therein. The package also has notches or slits aligned with the direction of film orientation so that the slits will not rupture during the heat shrinking process, or when the package is moved by utilization of the carrying means. The slits are rupturable upon application of an appropriate force so that one can access the containers disposed within the package.

BRIEF DESCRIPTION OF THE DRAWINGS

The organization and manner of the structure and operation of the invention, together with further objects and advantages thereof, may best be understood by reference to the following description taken in connection with the accompanying drawings, wherein like reference numerals identify like elements in which.

DETAILED DESCRIPTION OF THE PREFERRED EMBODIMENT

Figure 1:
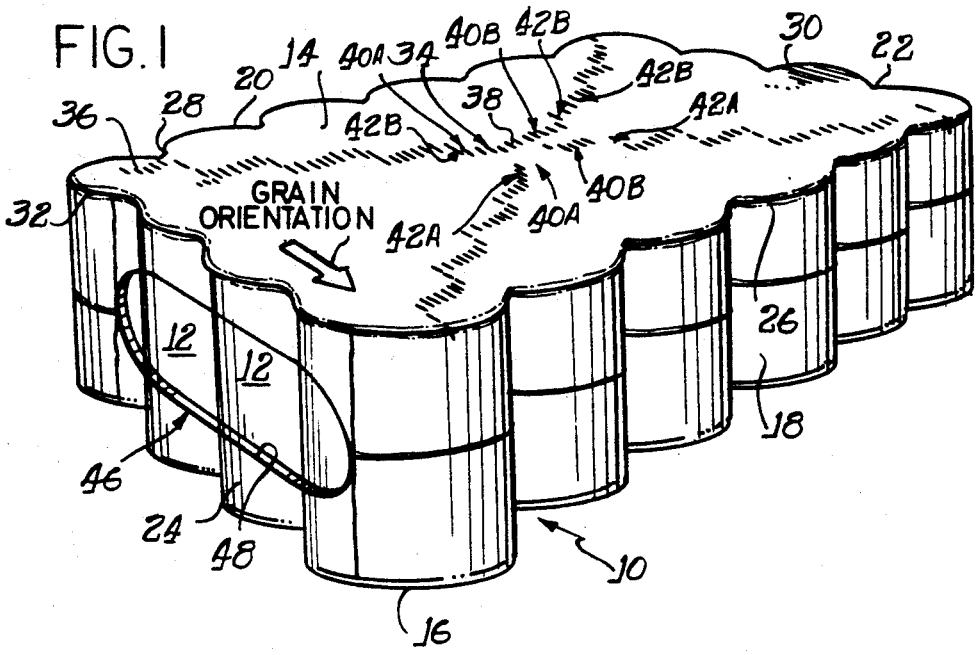
FIG. 1 is a perspective view of an easy-open, tear-apart package, constructed according to the teachings of the present invention, releasably retaining a plurality of containers, showing the unique construction thereof.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Referring initially to FIG. 1, an easy-open, tear-apart package 10, constructed according to the teachings of the present invention, releasably retaining a plurality of containers 12 is illustrated. Although the containers 12 depicted in FIG. 1 are substantially cylindrical in nature, it is to be understood that the package 10 and the teachings of this invention can be successfully employed with a number of different container configurations.

The package 10 is constructed from a blank or sheet of a flexible, resilient, heat shrinkable polymetric film material having a pre-determined molecular structure. The material of the blank should be sufficiently flexible and resilient to conform generally to the external configuration of the plurality of containers 12 upon application of the blank to the plurality of containers 12, and should have appropriate physical characteristics so that the blank will conform strictly to the external configuration of the plurality of containers 12 after the heat shrinking process. The blank may be transparent or translucent, or may be printed with a desired pattern using an appropriate pigmentation.

To form the package 10, the plurality of containers 12 are grouped together to form a desired external configuration. The number of containers 12 used to form the package 10 does not affect the operation of forming the package 10. The blank is then wrapped around the exterior of the containers 12 and subjected to a known heat shrinking process or other type of stress applying process. The package 10 is generally composed of a number of sides equal to the number of sides generally defined by the external configuration of the plurality of containers 12. For clarity, the invention will be disclosed in detail with respect to a rectangular external configuration of the plurality of containers 12, although it is to be understood that the invention operates equally well with differently shaped external configurations and differently shaped containers 12.

Specifically, the package 10 is composed of side means in the form of six sides or ends: a first side or end 14, a second side or end 16, a third side or end 18, a fourth side or end 20, a fifth side or end 22, and a sixth side or end 24, shown clearly in FIG. 1. The first side 14, the second side 16, the third side 18, and the fourth side 20 are substantially planar, although the first side 14 does differ from the generally planar configuration somewhat. The first side 14 opposes the second side 16, the third side 18 opposes the fourth side 20, and the fifth side 22 opposes the sixth side 26.

The first side or end 14 is substantially parallel to the second side 16, and substantially perpendicular to the other sides 18 through 24. The first side 14 terminates at, and is joined to all of the sides 18 through 24. All of the sides 18 through 24 join the first side 14 with the second side 16. The first side 14 is joined to the third side 18 along a first edge 26, to the fourth side 20 along a second edge 28, to the fifth side 22 along a third edge 30, and to the sixth side 24 along a fourth edge 32. The edges 26 through 32 are defined by the external configuration of the plurality of containers 12, and generally define substantially right angles, although other angles may be defined depending upon the external configurations of the containers 12. The second side 16 is joined to the sides 18 through 24 is the same fashion as the first side or end 14, thereby defining edges corresponding to the edges 26 through 32. Thus, the first side 14 is joined to the second side or end 16 through the sides 18 through 24.

Figure 4:
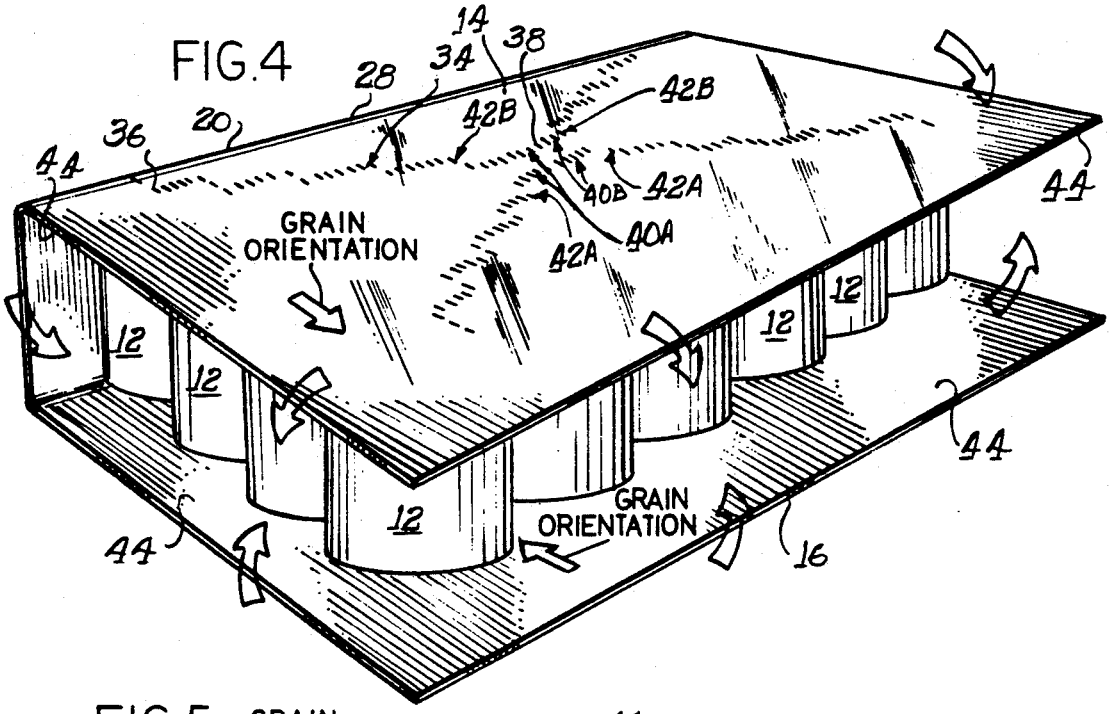
FIG. 4 is a view similar to the view of FIG. 1 illustrating the disposition of the sheet of material forming the package before it is subject to the heat shrinking process.

Means 34 for releasing the containers 12, in the form of notches which do not pierce the first side 14, or slits, or perforations, generally designated by the reference numeral 36, are disposed on the first side 14 in a unique configuration. As shown in FIG. 1 and FIG. 4, the slits 36 are disposed on the first side 14 in an essentially intersecting diagonal staircase fashion. Specifically, a slit segment 38 extends a certain distance about a center of the first side 14 along a latitudinal midline of the package 10.

The slit segment 38 does not extend completely across the entire first side 14, but extends only a definite distance from the center of the first side 14 towards the third side 18 and the first edge 26, and the fourth side 20 and the second edge 28. At each terminal end of the slit segment 38, a pair of second slit segments 40A and 40B extend substantially perpendicularly away from the slit segment 38. The second slit segments 40A extend a certain distance along the first side 14 substantially perpendicularly away from the ends of the slit segment 38 towards the sixth side 24 and the fourth edge 32. The second slit segments 40B extend a certain distance along the first side 14 substantially perpendicularly away from the ends of the slit segment 38 towards the fifth side 22 and the third edge 30.

The second slit segments 40A do not extend completely to the sixth side 24 and the fourth edge 32, and the second slit segments 40B do not extend completely to the fifth side 22 and the third edge 30. An end of the second slit segments 40A and 40B opposite to the ends thereof defined by the slit segment 38 terminate at third slit segments 42A and 42B. The third slit segments 42A and 42B extend substantially perpendicularly away from the second slit segments 40A and 40B.

Specifically, the third slit segments 42A extend substantially perpendicularly towards the third side 18 and the first edge 26 a specifically limited distance, while the third slit segments 42B extend substantially perpendicularly towards the fourth side 20 and the second edge 28 a similarly specifically limited distance. The third slit segments 42A extend substantially perpendicularly away from one part of each of the second slit segments 40A and 40B on one end of the slit segment 38, and the the third slit segments 42B extend substantially perpendicularly away from one part of each of the second slit segments 40A and 40B on an opposite end of the slit segment 38.

Additional slit segments are added to the general pattern defined by the slit segments 38, 40A, 40B, 42A, and 42B in similar fashion to define the particular staircase-like slit configuration illustrated in FIG. 1 and FIG. 4. Specifically, the slit segments 40A, 40B, 42A, and 42B extend in a diagonal fashion from the slit segment 38 positioned about the center of the first side 14 towards the intersections of the first edge 26 with the third and fourth edges 30 and 3 and the intersections of the second edge 28 with the third and fourth edges 30 and 32. Preferably, as shown in FIG. 1, the general slit pattern is continued so that it extends across the first and second edges 26 and 28, and continues for a specified distance along the third and fourth sides 26 and 28, respectively, so as to allow greater access to the containers 12 when the package 10 is opened, as will be discussed below.

The individual slits, notches, or perforations comprising the slit segments 38, 40A, 40B, 42A, and 42B are also configured in a unique fashion. As shown in FIG. 1 and FIG. 4, the slits have axes of elongation aligned parallel to the direction of film orientation comprising the package. The slits actually extend along the longitudinal axis of the blank and, when properly formed, along the latitudinal axis of the package 10. Specifically, the axes of elongation of the slits extended along, and are in grain with the molecular structure of the sheet material comprising the package. The axes of elongation of the slits are substantially parallel to the molecular structure of the material. Furthermore, the blank is applied to the articles so that the molecular orientation extends around the four sides 18 through 24 which are placed under the greatest tension during the heat shrinking, or other tension applying process. This particular slit configuration and orientation assures that the slits will not open or tear under the influence of forces attendant with the heat shrinking process.

Figure 5:
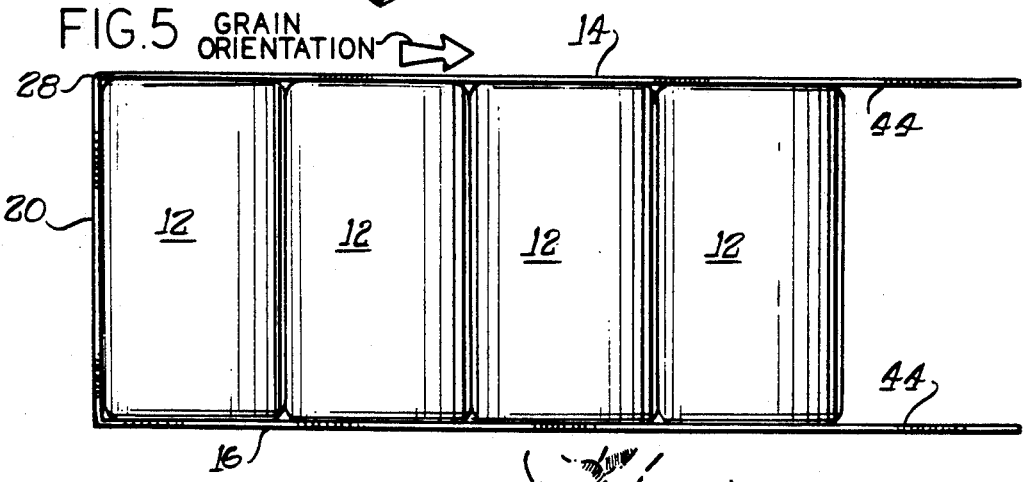
FIG. 5 is an end view of the package illustrated in FIG. 4.

In order to form the package 10, the desired number of containers 12 is arranged in a desired pattern, such as a rectangle, for example. The sheet of flexible, resilient heat shrink material is wrapped around the pattern of containers 12 to completely cover four sides of the pattern, as shown in FIG. 4 and FIG. 5. Due to the flexibility and resiliency of the sheet material, the sheet conforms closely to the general external configuration defined by the containers 12. Thusly, the first through fourth sides 14 through 20 of the package 10 are defined. The first side 14 of the package 10 is then scored or cut in order to dispose the means for releasing containers 34 on the first side 14. This scoring or cutting may take place either before or after the heat shrinking process.

At this point, as shown in FIG. 4, portions 44 of the package 10 extend beyond the third and fourth edges 30 and 32. These portions 44 form carrying means 46 in the form of bullseyes or constricted peripheries 48, illustrated clearly in FIG. 1 and FIG. 6, as will be discussed more fully herein.

Figure 3:
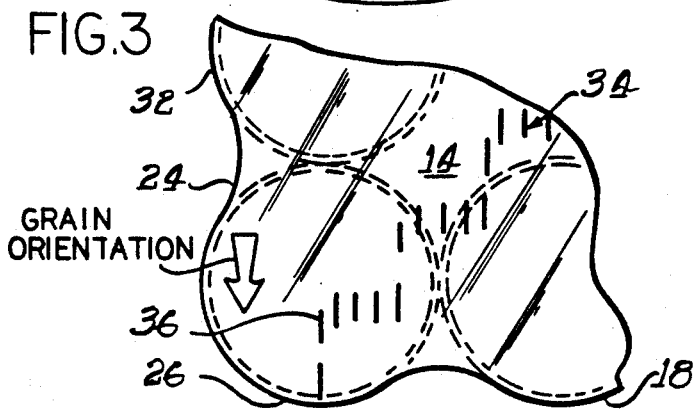
FIG. 3 is a partial top view of a corner of the package shown in FIG. 1 showing the strict conformity of the package to the external configuration of the plurality of containers.

The package 10 is fed into a source of thermal energy, such as a heat tunnel or the like, well known in the art, in order to cause the flexible heat shrink material to contract. As the sheet material contracts under the influence of the thermal energy, the sheet conforms more closely to the external configuration defined by the containers 12, and constricts firmly around the containers 12, as shown in FIG. 3, thereby firmly holding them together as a unit.

The portions 44 also contract. As they do, the portions 44 define the fifth and sixth sides 22 and 24, thereby completing the package 10, and firmly retaining the containers 12. Specifically, the portions 44 are not long enough to form a continuous fifth and sixth sides 22 and 24, but cover substantial portions of the containers 12 to assure that they are retained within the package 10.

Figure 6:
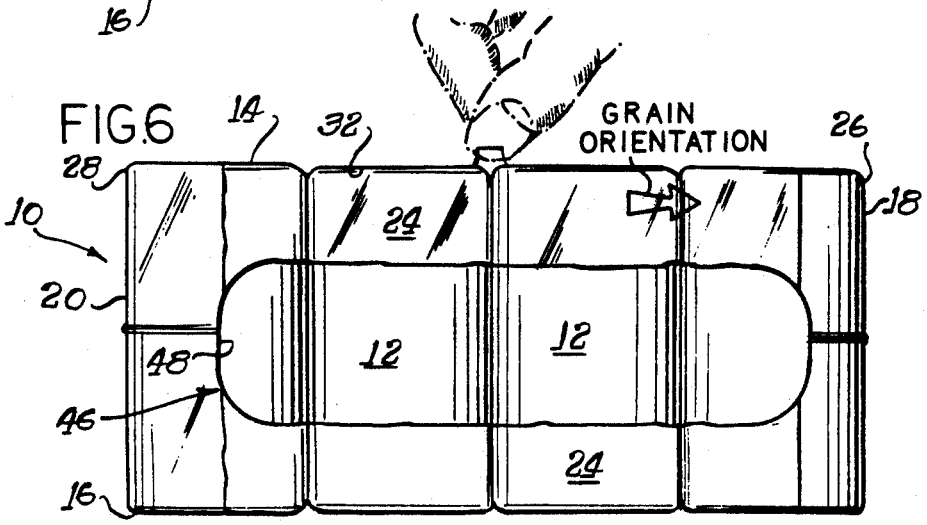
FIG. 6 is an end view showing of the package of FIG. 1 clearly showing the carying means, and showing a method for opening the package.

As the portions 44 contract, they define the bullseye or constricted periphery 48 shown in FIG. 1 and FIG. 6. There is at least one bullseye 48 on at least one of the sides 14 through 24 of the package 10. The bullseye 48 is of sufficient size to accept human fingers, and is strong enough so that a person moving the package by means of the bullseyes 48 will not rupture the package 10 by so moving. When the bullseyes 48 are used to move the package 10, the particular orientation and configuration of the means 34 for releasing the containers 12, along with the strength of the bullseye periphery, assures that the slits will not open. The package 10 is now complete.

Figure 2:
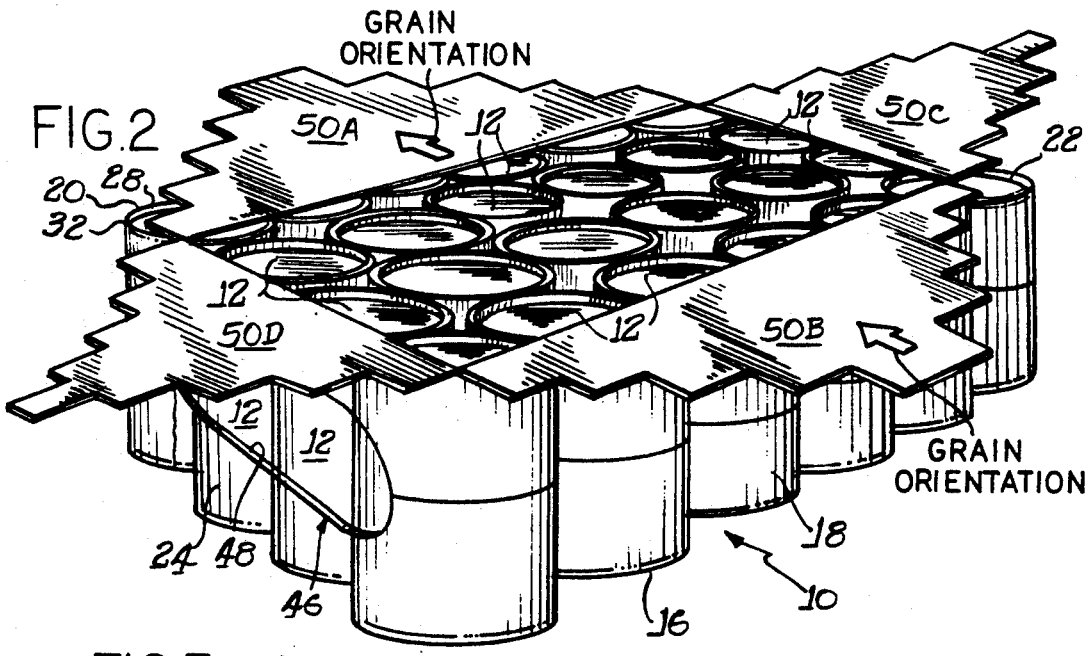
FIG. 2 is a perspective view of the easy-open, tear-apart package shown in FIG. 1 with the essentially intersecting diagonal perforations ruptured, thereby allowing access to the containers.

To open the package 10, all a person need do is to insert his fingers into the slit segment 38, as shown in FIG. 6. As the fingers are inserted, the slits on the slit segment 38 rupture to allow for easy insertion of the fingers. Once the fingers are inserted, the person grasps the first side 14 and applies an upwardly and outwardly directed force thereto. This force causes all of the slits on the package 10 to rupture, thereby forming four tear portions 50A, 50B, 50C, and 50D, shown in FIG. 2. Now the containers 12 are freely accessible and removable from the package 10. However, even after all of the slits have been ruptured, the carrying means 46 still functions effectively to allow for easy movement of the package 10. Additionally, the force applied by the person does not have to rupture all of the slits. If desired, a smaller subset of the slits can be ruptured to allow access to only a subset of the containers 12 retained within the package 10.

The package 10, constructed according to the teachings of the present invention, provides and easy-open, tear-apart way for retaining a plurality of containers 12 together as a unit. The incomplete wrapping of the containers 12 allows the carrying means 46 to be integral with the package 10 itself, thereby adding greater structural integrity. The particular slit configuration assures that the slits will not open during the heat shrinking process. Also, the particular construction of the package 10 allows it to be used without the need for sub-packages or trays.

While a preferred embodiment of the present invention is shown and described, it is envisioned that those skilled in the art may devise various modifications of the present invention without departing from the spirit and scope of the appended claims. The invention is not intended to be limited by the foregoing disclosure, but only by the following appended claims.

The invention claimed is:

1. A package for releasably retaining a plurality of containers together as a unit comprising: side means for forming said package; said side means comprising a sheet of plastic material having a pre-determined grain orientation; a plurality of slits disposed on the side means; the slits having axes of elongation aligned substantially parallel to the pre-determined grain orientation of the material; the slits defining adjacent slit segments with adjacent slits being offset from each other primarily transversely of the pre-determined grain orientation; and the plastic material between the slits being selectively rupturable primarily in a direction transverse of the pre-determined grain orientation to release the containers from the package.

2. A package as defined in claim 1 wherein the material is shrinkable upon application of thermal energy.

3. A package as defined in claim 1 wherein the plurality of slits is arranged in an intersecting diagonal configuration.

4. A package as defined in claim 1 further comprising carrying means for moving the package.

5. A package as defined in claim 4 wherein the carrying means comprises a bullseye at an end of the package of dimensions sufficient for accepting a human finger.

* * * * *

UNITED STATES PATENT AND TRADEMARK OFFICE

CERTIFICATE OF CORRECTION

PATENT NO. : 5,160,030

DATED : November 3, 1992

INVENTOR(S) : Michael A. Binsfield

It is certified that error appears in the above-identified patent and that said Letters Patent is hereby corrected as shown below:

Column 2, Lines 48-49

"free to the containers" should be —free access to the containers —

Column 5, Line 40

"edges 30 and 3" should be — edges 30 and 32 —

Signed and Sealed this

Second Day of November, 1993

*Attest:*

*Attesting Officer*

BRUCE LEHMAN

*Commissioner of Patents and Trademarks*